US010890400B2

(12) United States Patent
Christandl et al.

(10) Patent No.: US 10,890,400 B2
(45) Date of Patent: Jan. 12, 2021

(54) FASTENING DEVICE FOR WEAPON ACCESSORY

(71) Applicant: Dieter Christandl, Weiz (AT)

(72) Inventors: Dieter Christandl, Weiz (AT); Oliver Fischer, Hard (AT); Robert Hofer, Raab (AT); Alexander Haider, Albersdorf (AT); Josef Christandl, Raab (AT)

(73) Assignee: Dieter Christandl, Weiz (AT)

( * ) Notice: Subject to any disclaimer, the term of this patent is extended or adjusted under 35 U.S.C. 154(b) by 0 days.

(21) Appl. No.: 16/008,680

(22) Filed: Jun. 14, 2018

(65) Prior Publication Data

US 2018/0292161 A1 Oct. 11, 2018

Related U.S. Application Data

(63) Continuation of application No. PCT/EP2016/074431, filed on Oct. 12, 2016.

(51) Int. Cl.

| | |
|---|---|
| ***F41A 21/30*** | (2006.01) |
| ***F41A 21/32*** | (2006.01) |
| *F41G 11/00* | (2006.01) |
| *F41G 1/35* | (2006.01) |

(52) U.S. Cl.

CPC ..... *F41A 21/30* (2013.01); *F41A 21/325* (2013.01); *F41G 1/35* (2013.01); *F41G 11/003* (2013.01)

(58) Field of Classification Search

CPC ..... F41A 21/30; F41A 21/325
USPC ..... 89/14.2–14.4; 181/223; 42/106, 90
See application file for complete search history.

(56) References Cited

U.S. PATENT DOCUMENTS

| | | | | | |
|---|---|---|---|---|---|
| 4,479,418 | A | * | 10/1984 | Beretta | F41A 21/30 89/14.4 |
| 4,944,213 | A | * | 7/1990 | Ewert | F41A 21/325 89/14.3 |
| 5,136,924 | A | | 8/1992 | Förster et al. | |
| 5,179,235 | A | * | 1/1993 | Toole | F41G 1/35 362/110 |
| 5,208,826 | A | * | 5/1993 | Kelly | F41G 1/35 248/176.1 |

(Continued)

FOREIGN PATENT DOCUMENTS

| | | | | |
|---|---|---|---|---|
| DE | 41 01 171 | A1 | 8/1991 | |
| WO | WO-2008119098 | A1 * | 10/2008 | F41A 19/11 |
| WO | 2015001129 | A1 | 1/2015 | |

OTHER PUBLICATIONS

International Search Report issued for corresponding International Patent Application No. PCT/EP2016/074431, dated Nov. 8, 2016.

(Continued)

*Primary Examiner* — Reginald S Tillman, Jr.
(74) *Attorney, Agent, or Firm* — Myers Wolin, LLC

(57) ABSTRACT

A fastening device is provided for fastening a weapon accessory to a firearm, in particular a hand-held firearm, and to a weapon accessory having a fastening device according to the invention. The weapon accessory is in particular a silencer or a tactical light. The fastening device has a fastening rail, wherein at the rear end of the fastening rail a support surface is formed which rests at least partially on the front end of the trigger of the firearm when the fastening device is fastened to the firearm.

5 Claims, 4 Drawing Sheets

(56) References Cited

U.S. PATENT DOCUMENTS

| | | | | |
|---|---|---|---|---|
| 6,393,752 | B1 * | 5/2002 | Oliver | F41G 1/35 362/110 |
| 9,488,437 | B1 * | 11/2016 | Schnog | F41J 5/10 |
| 2005/0279004 | A1 | 12/2005 | Woodmansee, III et al. | |
| 2007/0234628 | A1 * | 10/2007 | La France | F41G 11/003 42/146 |
| 2012/0124885 | A1 | 5/2012 | Caulk et al. | |
| 2017/0023324 | A1 * | 1/2017 | Xu | F41A 17/54 |

OTHER PUBLICATIONS

Office Action issued by the German Patent and Trademark Office for corresponding German Patent Application No. 10 2015 122 091.1, dated Nov. 17, 2016, with an English translation.

* cited by examiner

FASTENING DEVICE FOR WEAPON ACCESSORY

CROSS REFERENCE TO RELATED APPLICATIONS

This application is a continuation of International Application No. PCT/EP2016/074431, filed on Oct. 12, 2016, which takes priority from German Patent Application No. 10 2015 122 091.1, filed on Dec. 17, 2015, the contents of each of which are incorporated by reference herein.

TECHNICAL FIELD

The invention relates to a fixing device for fixing gun accessories to a gun, in particular, a handgun. In particular, the gun accessory is a silencer or a tactical light. Further, the invention relates to a gun accessory, in particular, silencers having a fixing device according to the invention.

BACKGROUND

The term "handguns" relates to hand-held firearms, as blowback operated weapons, or gas operated weapons, pistols, and the like. The invention will be described by means of the example of a handgun, although the present invention is not limited to the latter and might just as well be implemented in long guns.

It is known to equip firearms with accessories or to attach accessories to guns. For example, it is known to arrange a tactical light or a silencer, for example, at a pistol.

FIG. 1 shows a silencer 10 known from prior art, which is fixed to a gun 90, wherein, here, only the front end of the gun is shown, i.e., only the breech/barrel 91 of the gun 90.

Below the breech/barrel 91, at the handle of the gun there is provided a mounting rail, at which the silencer can be attached. For the fixation, a fixation rail 30 of the silencer 10 is fitted on the mounting rail of the gun. The mounting rail 30 is arranged at the rear end, i.e., at the end facing the gun, of the silencer housing 11.

This type of fixation has the advantage that the silencer 10 can be fixed to the gun 90 independently of the breech/barrel. However, it is disadvantageous that upon firing off a shot, the silencer 10 starts to oscillate, in particular, if the handle is made from plastic, for example polyamide. The silencer, thereby, may oscillate in different directions, in particular, horizontally (shown by the arrow P1) and vertically (shown by the arrow P2). Hereby, the silencer oscillates independently of the movement of the barrel such that the gun may possibly be ready to fire again, while the silencer still oscillates. While the silencer is oscillating, the central axis of the barrel does not run coaxially to the central axis of the shot channel 20 formed in the silencer such that no further shot can be fired off as long as the silencer is oscillating. This disadvantage has a great impact, in particular, with respect to semiautomatic or fully automatic guns. With respect to guns with repeating mechanism, this disadvantage, where appropriate, can be negligible, if the reloading process lasts longer than the oscillation of the silencer.

Therefore, it is desirable to provide solutions, which at least partly avoid the disadvantages known from prior art, and which substantially avoid or at least prevent oscillation of a gun accessory, in particular, a silencer fixed to the handle such that the firing off of one or more shots is not impaired.

SUMMARY

This object, among others, is solved by a fixing device for fixing gun accessories, in particular silencers, to a gun, a gun accessory having the fixing device according to the invention, and a silencer for a gun. Preferred embodiments and further developments of the invention are specified in the following disclosure.

Accordingly, a fixing device for fixing gun accessories, in particular, silencers to a gun, in particular, a handgun is provided, wherein the fixing device comprises a fixation rail for fixing the fixing device to a mounting rail of the gun, wherein a support surface is formed at the rear end of the fixation rail, which rests at least in sections at the front end of the trigger of the gun, if the fixing device is fixed to the gun.

Thereby, vertical oscillation of the silencer fixed to the fixing device is prevented.

With respect to the fixing device mentioned above

- the surface of the support surface facing the trigger has a convex curvature, and
- the front end of the trigger may be formed as end wall-sided counter-support surface, which at least in sections corresponds to the convex support surface.

It is advantageous, if the support surface of the fixation rail rests substantially flush at the end wall-sided counter-support surface, if the fixing device is fixed to the gun.

The support surface of the fixation rail may comprise an axial recess, with which an axial protrusion or pin arranged at the front end of the trigger engages preferably in a positive-locking manner, if the fixing device is fixed to the gun.

At the rear end of the fixation rail, two axial blades spaced apart from each other may be provided, which at least in sections protrude in axial direction at the support surface.

It is advantageous, if the distance between the two blades is selected such that it basically corresponds to the width of the front end of the trigger such that the front end of the trigger engages between the two blades at least in sections substantially in a positive-locking manner, if the fixing device is fixed to the gun.

Thereby, horizontal oscillation of the silencer fixed to the fixing device is prevented.

The support surface may extend between the two blades and perpendicular with respect to the two blades.

A locking means may be provided at the fixation rail, in order to lock the fixing device at the gun.

The locking means may comprise at least one locking rocker, which is arranged pivotably about a pivot axis at the rear end of the fixation rail, and which can be brought from a locking position into a release position, wherein the locking rocker is aligned substantially in parallel to the longitudinal axis of the fixation rail, and in a state of the fixing device being fixed to the gun, can be brought into engagement with the trigger of the gun, in order to lock the fixing device at the gun.

Further, a fixing device for fixing gun accessories, in particular, silencers to a gun, in particular, a handgun is provided, wherein the fixing device comprises a fixation rail for fixing the fixing device to a mounting rail of the gun, wherein at least one locking rocker is arranged pivotably about a pivot axis at the rear end of the fixation rail, which can be brought from a locking position into a release position, wherein the locking rocker is aligned substantially in parallel to the longitudinal axis of the fixation rail, and in a state of the fixing device being fixed to the gun, can be brought into engagement with the trigger of the gun, in order to lock the gun at the fixing device.

Further, a gun accessory, in particular, silencers for a gun, in particular, a handgun is provided, wherein the gun accessory comprises a fixing device as disclosed.

The gun accessory and the fixing device may be formed in one piece or in two pieces.

Further, a silencer for a gun, in particular, a handgun is provided, wherein a fixing device is arranged at the front side of the silencer facing the gun.

BRIEF DESCRIPTION OF THE DRAWINGS

Details and features of the invention as well as concrete embodiments of the invention can be derived from the following description in connection with the drawing, in which.

DETAILED DESCRIPTION

The fixing device for fixing a gun accessory to a gun described in the following has the advantage that the gun accessory, on the one hand, may be fixed to the gun independently of the barrel/breech, and on the other hand, in particular, with respect to a silencer it is ensured that an oscillation of the gun accessory, in particular, after firing off a shot, is substantially prevented. A silencer fixed to a gun thereby allows for the semiautomatic or fully automatic operation of the gun. In the following, the fixing device, gun, and accessory are described on the basis of an example of a silencer, wherein the invention is not limited thereto. For example, according to the invention, also a tactical light or the like may be fixed.

Figure 1:
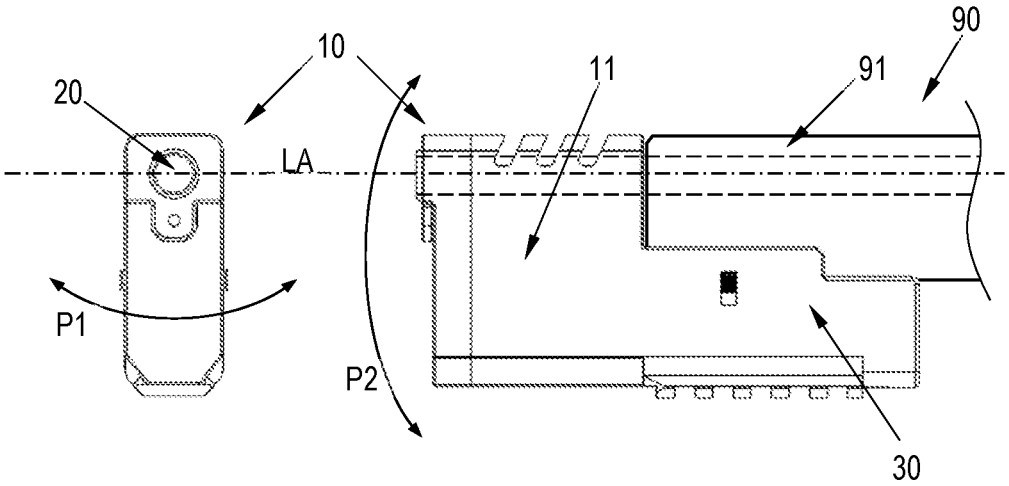
Fig. 1 Prior Art
FIG. 1 shows a silencer known from prior art fixed to a gun.
Figure 2:
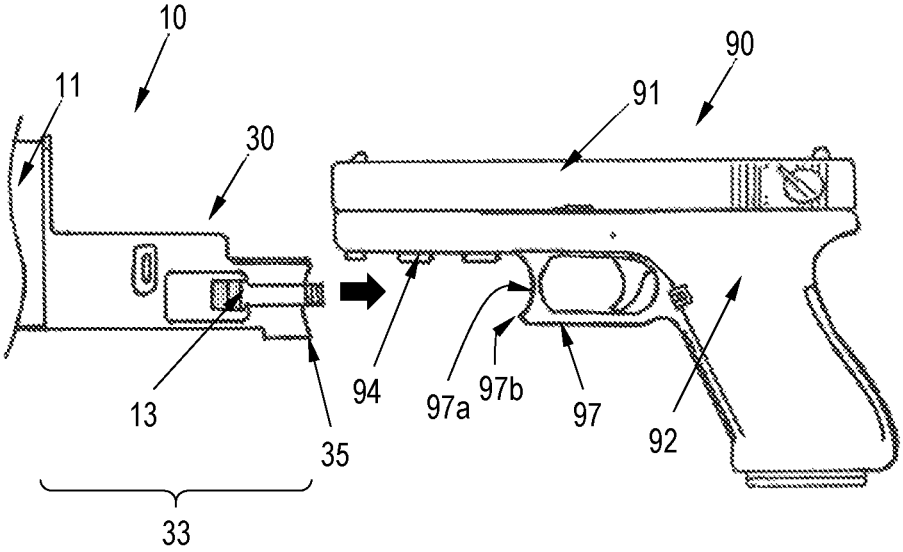
FIG. 2 shows a fixing device for fixing a gun accessory (here: a silencer) to a gun.

FIG. 2 shows a fixing device for fixing a gun accessory to a gun 90. In the example shown in FIG. 2, the gun accessory is a silencer 10.

The silencer 10, here, consists of a silencer housing 11 and a fixation rail 30 arranged at the rear end wall of the silencer housing 11. The rear end wall of the silencer housing 11, hereby, is that end wall, which is facing the barrel/breech 91 when fixing the silencer to the gun 90.

The fixation rail 30, alternatively, may also be arranged at a lower side wall of the silencer housing, and may extend beyond the rear end wall of the silencer.

The fixation rail 30 and the silencer may be formed in one piece or in two pieces. The fixation rail 30 and the silencer arranged thereon, in the following, are commonly referred to as silencer 10.

The fixation rail, hereby, forms the fixing device.

Figure 5:
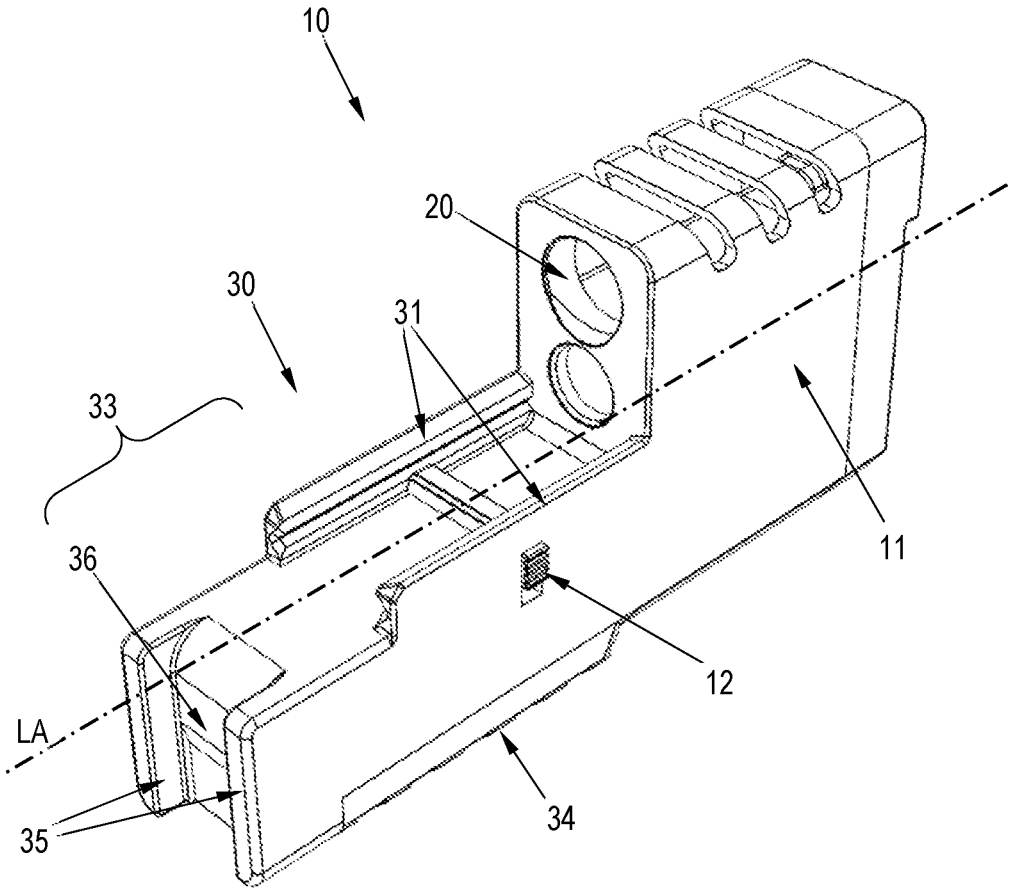
FIG. 5 shows a silencer.

A mounting rail 94 is provided at the lower side of the handle 92 of the gun 90, onto which the fixation rail 30 may be pushed (along the arrow shown in FIG. 2). The barrel and the breech 91 are able to move independently of the silencer fixed to the fixation rail 30. A detailed view of the fixation rail 30 is shown in FIG. 5.

The rear end 33 of the fixation rail 30 has a support surface, the surface of which substantially corresponds to the end wall-sided surface 97*a* of the trigger 97. The end wall-sided surface 97*a* of the trigger, hereby, forms a counter-support surface for the support surface of the fixation rail 30. The support surface of the fixation rail 30 is further described with reference to FIG. 3, FIG. 4 and FIG. 5.

The silencer, for being fixed to the gun 90, is pushed completely onto the mounting rail 94 such that the support surface of the mounting rail 30 is supported substantially flush on the counter-support surface 97*a*. The silencer is locked at the gun by means of the locking rockers 13 arranged at the rear end 33 of the fixation rail 30 such that the silencer 10 is not able to loosen autonomously or unintendedly the from the gun.

Accordingly, the locking rockers 13 prevent a horizontal movement of the silencer 10 in the opposite direction of the arrow shown in FIG. 2. The locking rockers 13, hereby, are configured such that in the locking state, they engage with the trigger 97. Advantageously, the locking rockers 13 moreover, are dimensioned such that in the locking state, they push the support surface of the fixation rail 30 against the counter-support surface 97*a* of the trigger 97.

By the support surface of the fixation rail 30, with the silencer 10 mounted on the gun, resting on the counter-support surface 97*a* of the trigger 97, and being locked at the gun by means of the locking rockers 13 of the silencer, the silencer is reliably prevented from oscillating in vertical direction P2, after a shot has been fired from the gun. The front portion of the handle 92 no longer is able to swing downwards, because a downward movement is prevented by the fixation rail 30 resting on the counter-support surface 97*a* of the trigger 97. Thereby, the rigidity of the handle 92 is increased as a whole.

Further, also two axially protruding blades 35 are provided at the rear end of the fixation rail 30, which extend spaced apart from each other and substantially in parallel with respect to each other. The support surface of the fixation rail 30 extends between these two blades 35. The distance between the two blades is selected such that it substantially corresponds to the width of the end wall-sided portion (that portion at which the counter-support surface 97*a* is located). After the silencer has been pushed onto the mounting rail 94 completely, the two blades 35 extend laterally at the end wall-sided portion of the trigger 97. This means that the end wall-sided portion of the trigger 97 engages between the two blades 35 in a substantially positive-locking manner. By the engagement of the trigger 97 between the two blades 35, it is ensured that the silencer 10 oscillates in horizontal direction P1, after a shot has been fired from the gun. Further, thereby, the rigidity of the handle is increased even further.

By the measures mentioned above, the oscillation behavior of the silencer is improved such that also a semiautomatic or fully automatic operation of the gun is enabled. Namely, by these measures, and oscillation of the silencer is prevented almost completely after firing off a shot.

Further, a pin or an axial protrusion 97*b* may be provided at the front end of the trigger 97 or at the counter-support surface 97*a* of the trigger 97, which either engages with a recess at the support surface of the fixation rail corresponding thereto, or protrudes below the support surface of the fixation rail. Thereby, an even better fixation of the silencer fixed to the gun is achieved, in particular, a vertical movement of the rear end 33 of the fixation rail 30 relative to the trigger 97 is prevented such that a vertical oscillation of the silencer 30 is prevented even better.

With respect to the embodiment shown in FIG. 2, the counter-support surface 97*a* has a substantially concave surface. Accordingly, the corresponding support surface of the fixation rail 30 has a convex surface. Of course, it is also possible that the counter-support surface 97*a* has a substantially convex surface and the support surface has a substantially concave surface corresponding thereto.

In principle, the surfaces of the support surface and the counter-support surface may be configured arbitrarily. However, it is important that the two surfaces correspond to each other such that, with the silencer being mounted, the support surface of the fixation rail 30 rests on the counter-support surface, preferably, substantially in a positive-locking manner, and a downward movement of the rear end 33 of the fixation rail relative to the trigger is prevented.

Figure 3:
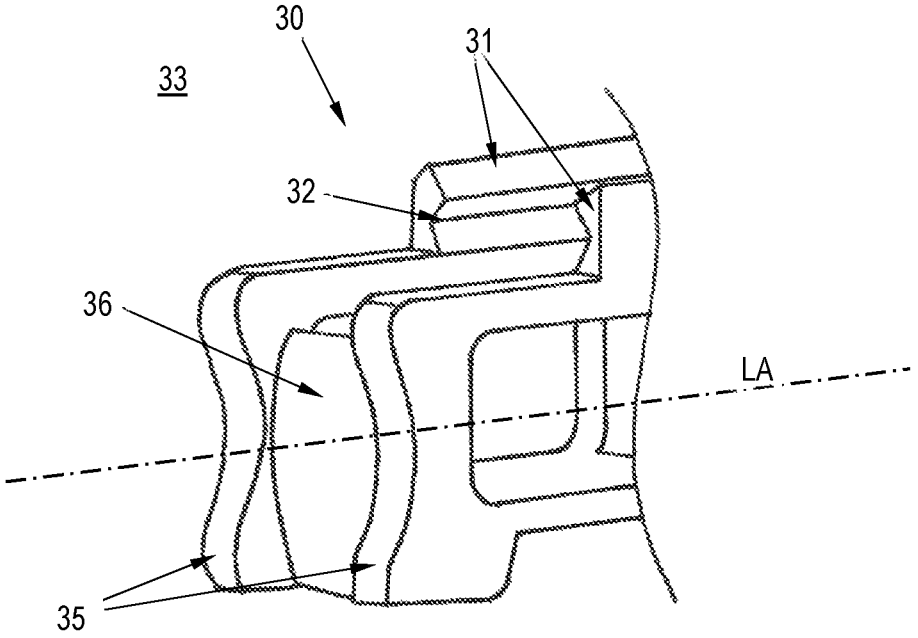
FIG. 3 shows the rear end of a fixing device in perspective view.

FIG. 3 shows the rear end 33 of a fixing device in a perspective view.

The fixation rail 30 of the fixing device has two upper side walls 31. The two side walls 31 respectively comprise inner longitudinal guides 32, which are configured as guide grooves. The guide grooves correspond to the mounting rail 94, which are provided at the handle 92 below the barrel/breech 91 at the gun. The silencer may be pushed onto the mounting rail of 94 of the gun by means of the longitudinal guides 32.

At the rear end 33, further, the support surface 36 is formed, which is substantially perpendicular to the longitudinal axis LA of the fixation rail 30. Further, the support surface 36 extends between two blades 35 formed at the rear end, wherein the blades 35 are arranged substantially perpendicular to the support surface 36, and run in parallel to the longitudinal axis LA of the fixation rail. The two blades 35 project backwards at the support surface 36.

The support surface 36 itself, here, has a convex surface and is configured such that it corresponds to a concave surface of the end wall-sided counter-support surface 97*a* of the trigger 97, and with the silencer being mounted, rests in a substantially positive-locking manner on the latter.

The distance between the two blades 35 with respect to each other is selected such that it substantially corresponds to the width of the front end of the trigger 97. When mounting the silencer, the front end of the trigger 97 engages with the two blades 35, wherein preferably, a form fit is created between the blades and the front end of the trigger 97, i.e., the rear end 33 of the fixation rail is not able to move in horizontal direction relative to the trigger 97.

The two side walls 31 with their longitudinal guides 32, here, do not extend up to the two blades 35 or at to the support surface 36, because the mounting rail usually ends in front of the trigger 97.

Figure 4:
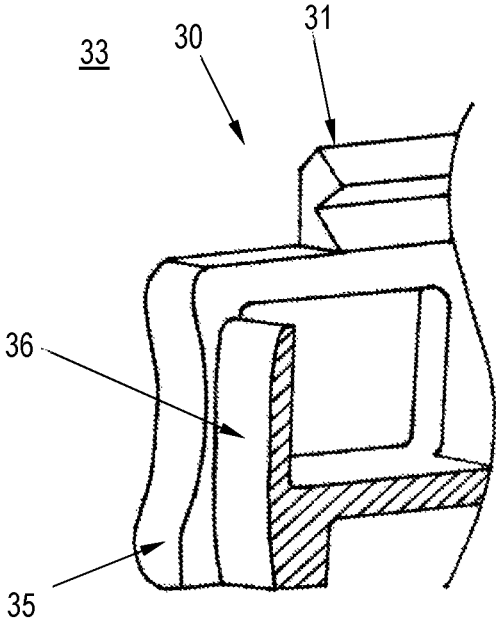
FIG. 4 shows a sectional view of the rear end of a fixing device shown in FIG. 4.

FIG. 4 shows the rear end 33 of a fixing device in a perspective view and in a sectional view.

Here, the convex surface of the support surface 36 can be seen well. Moreover, the rear end 33 of the fixing device shown in FIG. 4 corresponds to the rear end 33 shown in FIG. 3.

FIG. 5 shows a concrete example of a silencer 10 with a fixing device. The silencer or the silencer housing and the mounting rail 30, here, are formed in one piece or integrally. According to an alternative embodiment, the silencer and the fixation rail 30 may also be formed in two pieces, i.e., the silencer and the silencer housing 11 can be connected to the fixation rail 30 releasably.

At the top side of the fixation rail 30, here, two fixation rails 31 are provided, which substantially extend in parallel with respect to each other and are provided for fixing the silencer to the mounting rail of the gun. The two fixation rails 31 are configured such that they correspond to an external profile of a mounting rail 94 of the gun.

The mounting rail 30 may comprise a locking means configured as locking pin 12, by means of which the silencer fitted at the mounting rail of the gun can be locked at the gun, in order to prevent an autonomous or unintended loosening of the silencer from the gun. An alternative and, in particular, preferred embodiment of a locking device is described with reference to FIGS. 6A-C.

At the rear end 33 of the fixation rail 30, two blades 35 extending perpendicular, in parallel, and spaced apart from each other are arranged, which protrude in axial direction at the rear end 33 of the fixation rail 30. The distance between the two blades 35 with respect to each other, hereby, corresponds to the width of the front portion of a trigger 97 of the gun, to which the silencer is fixed. Further, the two blades 35 are arranged with respect to each other such that the front portion of the trigger 97, in a mounted state of the silencer, engages the gun between the two blades.

When the silencer is fixed to the gun, the front end or the front portion of the trigger 97 engages between the two blades 35 such that the sidewalls of the trigger rest substantially in a positive-locking manner at the two inner sides of the blades 95.

In the embodiment shown in FIG. 5, the support surface 36 extending between the two blades 35 does not have convex, but rather a substantially planar surface. The counter-support surface 97*a* of the trigger 97 is formed correspondingly.

The lower portion of the support surface 36 is slightly recessed, i.e., a kind of a step is formed between the upper portion and the lower portion of the support surface 36. A correspondingly formed protrusion of the trigger 97 engages with the lower, i.e., the recessed portion, and preferably rests on the surface of the recessed portion. The step formed between the two portions prevents that the rear end 33 of the silencer, with the silencer being mounted, tilts downwards. If the support surface 36 and the counter-support surface 97*a* are formed concave or convex, such a downward tilting is already prevented by the convex or convex configuration.

Instead of a lower recessed portion of the support surface 36, the support surface may also comprise a cavity or indentation, with which a protrusion (e.g., a pin) corresponding to the cavity or indentation arranged at the counter-support surface 97*a* engages.

At the lower side of the fixation rail 30, a further mounting rail 34 is provided, at which additional accessories may be arranged.

Figure 6A:
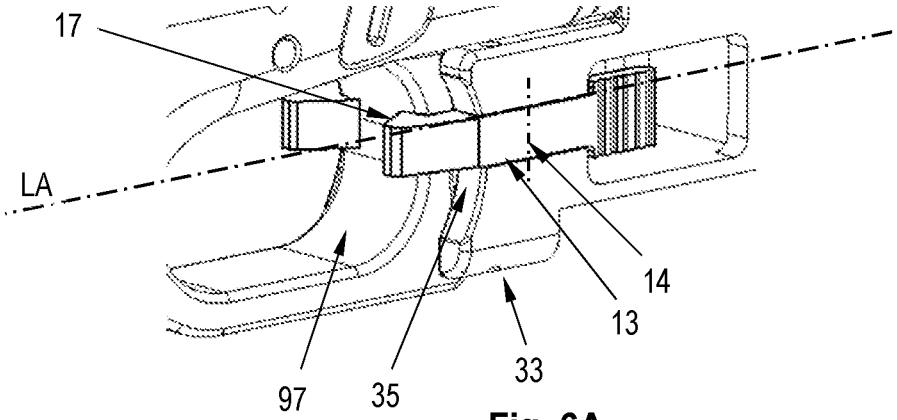
FIGS. 6A-C show a locking mechanism of a fixing device.
Figure 6B:
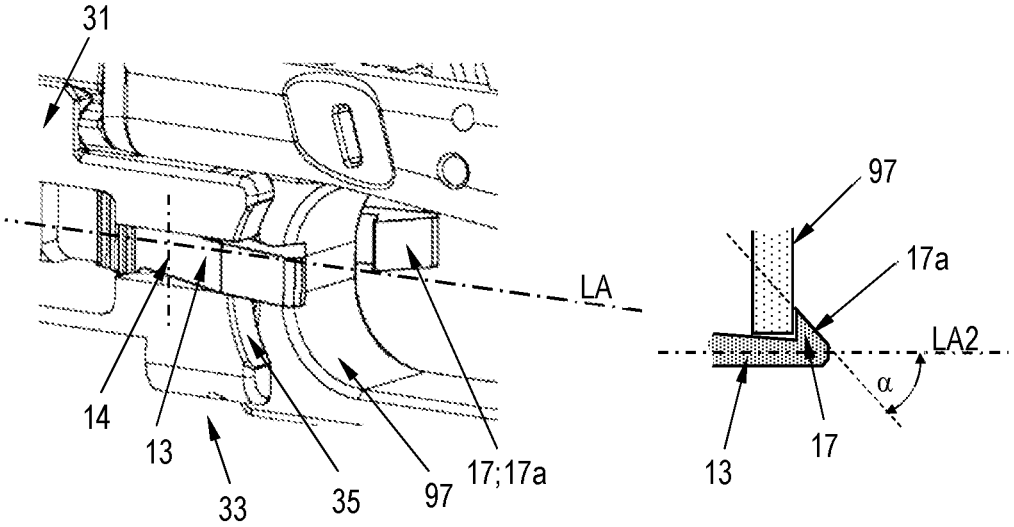
Figure 6C:
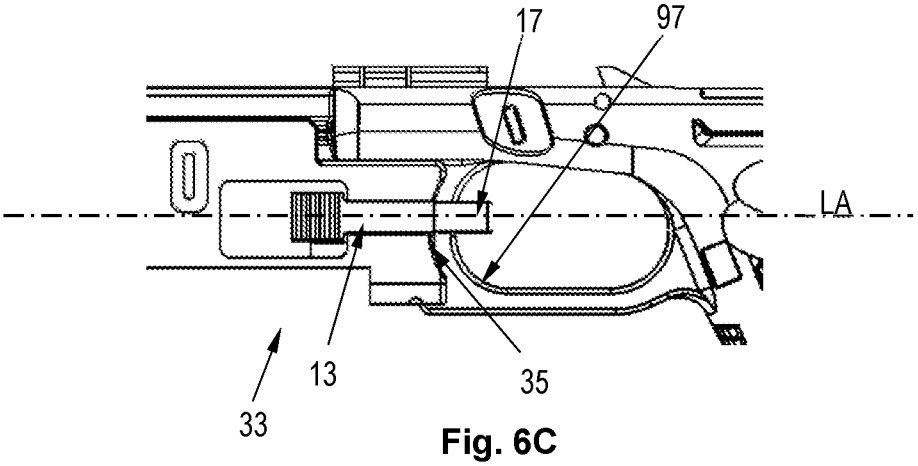

FIGS. 6A-C show a locking mechanism or locking means of a fixing device, wherein the silencer, here, is fixed to the gun, and wherein in FIG. 6A, the locking means is in a locking position, in FIG. 6B, the locking means is in a release position, and in FIG. 6C, the locking means is shown in a side view.

The locking means, here, consists of at least one locking rocker 13, which runs substantially in parallel to the longitudinal axis LA of the fixation rail, and is arranged at the rear end 33 of the fixation rail. The fixation rocker 13 is supported pivotably about the pivot axis 14 on the fixation rail such that the locking rocker 13 can be brought from a locking position (as shown in FIG. 6A) into a release position (as shown in FIG. 6B). In the release position, the silencer can be pulled off the gun.

The locking rocker 13 is arranged at the rear end 33 of the fixation rail, and in fact such that a portion of the locking rocker 13 protrudes beyond the rear end 33 of the fixation rail. The silencer is locked at the gun by means of the portion protruding beyond the rear end 33 of the fixation rail by bringing this portion into engagement with the trigger 97 of the gun. At the portion protruding beyond the rear end 33 of the fixation rail, a pin 17 is provided, which, in the locked state, engages with the trigger 97, and thus prevents an autonomous or unintended loosening of the silencer from the gun. Further, the support surface 36 of the fixation rail is pushed against the counter-support surface 97*a* of the trigger 97 by the engagement of the pin 17 with the trigger 97 such that the support surface 36 rests securely on the counter-support surface 97*a*. In the locked state, a horizontal movement of the silencer along the longitudinal axis LA of the gun is prevented such that the support surface 36 resting on the counter-support surface 97*a* together with the locking 13 prevent a vertical oscillation of the silencer efficiently.

The side of the pin 17 facing the trigger 97 has a surface 17*a*, which is formed sloping downwards inwards. I.e., the angle α enclosed by the surface 17*a* and the longitudinal axis LA2 of the locking rocker 13 is smaller than 90°, preferably, smaller than 75°, particularly preferred approximately between 40° and 50°. Thereby, the slanted surface 17*a*, when the silencer is pushed onto the mounting rail 94 of the gun, abuts against the trigger 97. The trigger 97 then pivots the pin 17 of the locking rocker 13 outwards, and the surface 17*a* or the pin 17 slides past the trigger 97. After the complete fitting of the silencer on the mounting rail 94 of the gun, the portion of the locking rocker 13 protruding beyond the rear and 33 of the fixation rail tilts back inwards such that the pin engages with the trigger 97. The locking rocker 13, then, is in the locking position. The tilting inwards may be effected by a spring member, which belongs to the locking rocker 13.

In order to bring the locking rocker 13 into the release position, only the portion not protruding beyond the rear end 33 of the fixation rail has to be pushed inwards. The portion protruding beyond the rear end 33 of the fixation rail or the pin 17, then, is pivoted outwards about the pivot axis 14 such that the pin 17 no longer engages with the trigger 97. Then, the silencer may be simply pulled off from the gun.

Thereby, on the one hand, a particularly simple locking and a particularly simple releasing of the locking is enabled. On the other hand, the support surface 36 of the fixation rail is pushed against the counter-support surface 97*a*.

With respect to the locking pin 12 shown in FIG. 5, the locking rocker 13 shown with reference to FIG. 6 has the advantage that no portions of the locking means protruding laterally beyond the fixation rail are present, while the locking means is in a locking position. Further, the locking pin 12 shown in FIG. 5 has the disadvantage that although the silencer is locked at the gun, it, however, is not ensured that the support surface 36 of the fixation rail is pushed against the counter-support surface 97*a*.

Advantageously, two locking rockers 13 are provided—one on each side wall of the fixation rail.

REFERENCE NUMERALS

10 gun accessory, in particular, silencer (or tactical light or the like)
20 shot channel
11 silencer housing
12 locking pin
13 locking rocker
14 rotation or pivot axis of the locking rocker 13
17 pin of the locking rocker 13
17*a* slanted surface of the pin 17
30 fixation rail
31 side wall of the fixation rail 30
32 longitudinal guide (e.g. guide grooves) of the fixation rail 30
33 rear end of the fixation rail 30
34 mounting rail at the lower side of the silencer 10
35 blade at the rear end 33 of the fixation rail 30
36 support surface between the blades 35
90 gun
91 breech/barrel
92 handle of the gun 90
94 mounting rail at the lower side of the gun 90 or at the lower side of the handle 92 in the area of the breech 91
97 trigger of the gun 90
97*a* front end of the trigger 97 or end wall-sided counter-support surface of the trigger 97
97*b* pin/protrusion at the end wall-sided counter-support surface 97*a*
LA longitudinal axis of the gun 90 or the silencer 10
LA2 longitudinal axis of the locking rocker 13
P1, P2 oscillation direction of the silencer 10 (prior art)
α angle between the longitudinal axis LA2 and the slanted surface 17*a*

What is claimed is:

1. A handgun (90) with a silencer (10) and with a fixing device for fixing the silencer (10) to a handle (92) of the handgun (90), wherein the fixing device comprises:

a fixation rail (30) for fixing the fixing device to a mounting rail (94) of the handgun, wherein the fixation rail (30) has two upper side walls (31), the two side walls respectively comprise inner longitudinal guides (32), which are configured as guide grooves, wherein the guide grooves correspond to the mounting rail (94), wherein the mounting rail (94) is provided at a horizontal section of the handle (92) directly below a barrel (91) and forward of a trigger guard (97) of the handgun (90), the fixation rail (30) is arranged at a rear end wall of a silencer housing (11) of the silencer (10), wherein the rear end wall of the silencer housing (11) is facing the barrel (91) of the handgun (90) when fixing the silencer (10) to the handgun (90), wherein the fixation rail (30) and the silencer (10) is formed in one piece, wherein a support surface (36) is formed at the rear end (33) of the fixation rail (30), which at least in sections rests on the front end (97*a*) of the trigger guard (97) of the handgun (90), if the fixing device is fixed to the handgun, wherein a surface of the support surface (36) facing the trigger guard (97) has a convex curvature, wherein the front end (97*a*) of the trigger guard (97) is formed as end wall-sided counter support surface, which at least in sections corresponds to the convex support surface (36), wherein the support surface (36) of the fixation rail (30) rests in a substantially positive-locking manner on the end wall-sided counter support surface (97*a*), if the fixing device is fixed to the handgun, such that the silencer (10) is reliably prevented from oscillating in a vertical direction (P2) after a shot has been fired from the handgun (90), and wherein the support surface (36) at the rear end (33) of the fixation rail (30) has an axial recess, with which an axial protrusion or pin (97*b*) arranged at the front end (97*a*) of the trigger guard (97) engages in a positive-locking manner, if the fixing device is fixed to the handgun.

2. The handgun of claim 1, wherein two blades (35) spaced apart from each other are provided at the rear end (33) of the fixation rail (30), which at least in sections protrude in axial direction at the support surface (36).

3. The handgun of claim 2, wherein the distance between the two blades (35) is selected such that it substantially corresponds to the width of the front end of the trigger guard (97) such that the front end of the trigger guard (97) at least in sections engages substantially in a positive-locking manner between the two blades (35), if the fixing device is fixed to the handgun.

4. The handgun of claim 2, wherein the support surface (36) extends between the two blades (35) and perpendicular to the two blades (35).

5. The handgun of claim 1, wherein a locking means (12; 13) is provided at the fixation rail (30), in order to lock the locking device at the gun, wherein the locking means comprises at least one locking rocker (13), which is arranged pivotably about a pivot axis (14) at the rear end (33) of the fixation rail (30), and which can be brought from a locking position into a release position, wherein the locking rocker (13) is aligned substantially in parallel to the longitudinal axis (LA) of the fixation rail (30), and in a state of the fixing device being fixed to the handgun, can be brought into engagement with the trigger guard (97) of the handgun (90) in order to lock the fixing device at the handgun.

* * * * *